United States Patent [19]

Kothe et al.

[11] 4,344,764

[45] Aug. 17, 1982

[54] DESIZING OF TEXTILES CONSISTING OF OR CONTAINING CELLULOSE

[75] Inventors: Wilfried Kothe; Heinz-Dieter Angstmann, both of Ludwigshafen, Fed. Rep. of Germany

[73] Assignee: BASF Aktiengesellschaft, Ludwigshafen, Fed. Rep. of Germany

[21] Appl. No.: 23,357

[22] Filed: Mar. 23, 1979

[30] Foreign Application Priority Data

Apr. 3, 1978 [DE] Fed. Rep. of Germany ..... 2814354

[51] Int. Cl.[3] ..... D06L 1/14; D06M 11/04; D06M 15/38; D06L 1/06

[52] U.S. Cl. ..... 8/138; 8/111

[58] Field of Search ..... 8/138, 111

[56] References Cited

U.S. PATENT DOCUMENTS

| | | | |
|---|---|---|---|
| 3,634,024 | 1/1972 | Yelin et al. | 8/138 |
| 3,765,834 | 10/1973 | Sitver et al. | 8/138 |
| 3,796,601 | 3/1974 | Kindron et al. | 8/138 |
| 4,095,947 | 6/1978 | Wolf et al. | 8/138 |

FOREIGN PATENT DOCUMENTS

| | | | |
|---|---|---|---|
| 65038 | 4/1974 | Australia | 8/138 |

OTHER PUBLICATIONS

Derwent Abs. 84717Y/48 (BE-855-048), 11-25-77, "Modified Starch Size for Glass Fibers . . . ", St. Gobain, Ind.

*Primary Examiner*—Joseph L. Schofer
*Assistant Examiner*—Herbert J. Lilling
*Attorney, Agent, or Firm*—Keil & Witherspoon

[57] ABSTRACT

In addition to the very time-consuming enzymatic and hydrolytic desizing processes, oxidative degradation of starch size by means of persulfate, to render the starch water-soluble, is conventionally practised. Because of the chemical similarity between starch and cellulose, oxidative degradation of the cellulose is unavoidable in this desizing process. The invention overcomes this problem by breaking up the macromolecules of the starch into dispersible fragments by means of such small amounts of persulfate that neither is the starch made water-soluble nor is the cellulose significantly damaged, the dispersants employed for the fragments being relatively oxidation-stable polymers of unsaturated carboxylic acids.

2 Claims, No Drawings

DESIZING OF TEXTILES CONSISTING OF OR CONTAINING CELLULOSE

The present invention relates to a process for oxidatively desizing a starch-sized textile material consisting of or containing cellulose, by means of a peroxydisulfate.

Cellulose is in the main sized with starch. This water-insoluble natural product must in general be removed in the course of the wet finishing process. To remove it, the starch must be converted to a water-soluble form. This can be done by enzymatic, hydrolytic or oxidative degradation. Enzymatic degradation requires much time (a dwell time of at least a few hours) and/or a separate process step; furthermore, the enzymes do not react equally to all types of starch. Hydrolytic degradation (with starch or alkali) is also a slow reaction, and brings the danger of hydrolytic damage to the fibers. Oxidative degradation also entails the danger of damage to the fibers, since, as is known, starch and cellulose are chemically very similar.

Peroxydisulfates, in particular in amounts of from about 5 to 10 g/l, have also already been employed for the purpose of oxidative degradation. For this treatment, it is necessary to strike a compromise between the desizing effect and damage to the fibers.

The present invention seeks to provide a desizing process which as far as possible avoids all disadvantages of the conventional processes. Ideally, such a process should require little time, desize reliably, minimize the danger of damage to the fibers and not require an additional process step but instead be effortlessly capable of being fitted into the normal finishing sequence.

According to the present invention there is provided a process for oxidatively desizing a starch-sized textile material consisting of or containing cellulose, wherein a desizing liquor is employed containing, per liter, (a) from 0.1 to 3 g of a peroxydisulfate as desizing agent, and (b) from 0.1 to 5 g of an oxidation-resistant, water-soluble dispersant for the water-insoluble starch molecule fragments formed by oxidative degradation of the starch size.

The amount of peroxydisulfate employed according to the invention (from 0.1 to 3, preferably from 0.4 to 1.7, g/l) is so low that the danger of an objectionable degree of damage to the fibers is avoided with certainty. It is true that the starch is also not degraded so far as to make it water-soluble, but such solubility is in fact not required. The starch is decomposed into sizable fragments, which are then dispersed by the dispersant (which is preferably a water-soluble maleic acid polymer or acrylic acid polymer or a water-soluble salt of such a polymer) also employed, and are removed during subsequent rinsing. Furthermore, the dispersant surprisingly protects the fibers. Accordingly, the invention basically comprises the combination of two novel measures, namely:

1. the use of lower amounts of peroxydisulfate than hitherto, which by virtue of being lower do not present any danger but have hitherto been regarded as inadequate, and 2. the use of an oxidation-resistant dispersant for the resulting starch fragments, which are still water-insoluble.

The polymers of acrylic acid and of maleic acid and their salts mentioned above have proved very good dispersants, since they are relatively resistant to oxidative attack. In principle it is of course also possible to employ other dispersants which are oxidation-resistant under the conditions used, any such dispersant being employed in a concentration of from 0.1 to 5, preferably from 1 to 4, g/l. Preferably the dispersant is employed in about the same amount as the peroxydisulfate, more preferably in a weight ratio of from 1:1 to 5:1.

The polymers of acrylic acid used for the purposes of the invention may be water-soluble homopolymers of acrylic acid or water-soluble copolymers of acrylic acid with one or more other ethylenically unsaturated compounds. The copolymers of acrylic acid suitably contain up to 50 percent by weight as copolymerized units of one or more ethylenically unsaturated compounds which are copolymerizable with acrylic acid, for example methacrylic acid, methacrylamide, arylamide, acrylonitrile, methacrylonitrile, acrylic acid esters, methacrylic acid esters and other ethylenically unsaturated monocarboxylic acids and dicarboxylic acids, for example crotonic acid and itaconic acid. The polymers preferably contain from 0 to 20 percent by weight of the comonomers; they can also contain two or more comonomers as copolymerized units, for example in the case of copolymers of acrylic acid, acrylonitrile and acrylamide. The copolymers which can be used are generally known and may be obtained by polymerizing acrylic acid or by copolymerizing acrylic acid with suitable comonomers. It is important that water-soluble polymers should be employed.

In addition to the water-soluble polymers of acrylic acid, mentioned above, water-soluble alkali metal salts or ammonium salts of acrylic acid polymers can also be used. These salts may be obtained either by polymerizing the alkali metal salts or ammonium salts of acrylic acid by themselves or as a mixture with one or more suitable comonomers, or by neutralizing acrylic acid polymers with alkali metal hydroxides, ammonia or amines. Preferably, the sodium salts are used, but the lithium salts and potassium salts are also suitable. Examples of amines which can be used are methylamine, ethylamine, dimethylamine, diethylamine, triethylamine, diethanolamine and triethanolamine.

Water-soluble salts of copolymers of maleic acid and styrene, maleic acid and one or more vinyl esters and maleic acid and one or more vinyl ethers have also proved to be very suitable dispersants according to the invention. The vinyl esters used are preferably vinyl acetate and vinyl propionate. Examples of suitable vinyl ethers are $C_1$–$C_4$ alkyl vinyl ethers, eg. methyl vinyl ether, n- and iso-propyl vinyl ether and n- and iso-butyl vinyl ether. The molar ratio of the monomers in the maleic acid copolymers mentioned is preferably about 1:1. The copolymers, like the polymers of acrylic acid, are normally used in the form of their alkali metal salts or ammonium salts.

Mixtures of dispersants of different types, for example mixtures of polyacrylic acid and the sodium salts or ammonium salts of a copolymer of maleic acid and styrene, can also be employed according to the invention.

The polymers of acrylic acid and maleic acid used as dispersants suitably have a viscosity (measured by means of the Höpple falling ball viscometer at 20° C. in accordance with DIN 53,015) of from 1 to 300 centipoise in 7.5 percent strength by weight aqueous solution brought to pH 9 with sodium hydroxide solution. Preferably, the viscosity is from 3 to 120 centipoise, measured in accordance with DIN 53,015.

Examples of peroxydisulfates are the sodium, ammonium and, preferably, potassium salts of peroxydisulfuric acid.

The reaction time for the desizing operation can be as little as one minute at about 100° C., and this thus corresponds to conditions employed, for example, in the alkali shock process. Longer reaction times (of 30 minutes or more) also do not cause any objectionable damage to the fibers. The process is generally carried out at from 20° to 130° C., preferably from 90° to 105° C., and at a pH of from 12 to 14, advantageously from 13 to 14.

Advantageously, the desizing according to the invention is combined with another finishing step, preferably an alkali extraction, so as not to require an additional process step. The degradation product can readily be removed in a conventional second wash. The advantages of the process are its simplicity and effectiveness, and the definite absence of objectionable damage to the fibers. The process for the first time allows a textile finisher to desize a starch-sized textile material without significant expense and without risk.

In the Examples, parts and percentages are by weight.

EXAMPLE 1

Cotton ticking (250 g/m$^2$), sized with a tapioca starch which is difficult to degrade (the warp carrying 20% of size), was impregnated, after singeing, with the following liquors:

(a) 10 g/l of bacterial amylase,
5 g/l of NaCl
3 g/l of alkylphenol-oxyethylate (10 molecules of ethylene oxide)
wet pick-up: 70%.

After 16 hours' dwell at room temperature, the fabric was washed hot in a 5-box open-width washer.

(b) 80 g/l of NaOH
4 g/l of gluconic acid
2 g/l of $C_{14/17}$-alkylsulfonate
wet pick-up: 65%.

After steaming for 1½ minutes at 103° C., the fabric was again washed hot in an open-width washer.

(c) 80 g/l of NaOH
4 g/l of gluconic acid
3 g/l of $K_2S_2O_8$
4 g/l of polyacrylic acid (K value 14–16, measured on a 1% strength solution in $H_2O$ by the method of Fikentscher, Cellulosechemie 13 (1932), 58–64 and 71–74)
2 g/l of $C_{14-17}$-alkylsulfonate
wet pick-up: 65%.

After steaming (1.5 minutes at 103° C.) the fabric was washed hot in an open-width washer.

| | Results: | | | |
|---|---|---|---|---|
| | Reflectance (%) | Degree of polymerization | Absorbency (s/cm) | Degree of desizing by the Tegewa method |
| Untreated textile | 55 | 3,010 | 0 | 1 |
| Treatment according to (a) | 57 | 3,000 | 0 | 1–2 |
| Treatment according to (b) | 62 | 2,950 | 30 | 3 |
| Treatment according to (c) | 63 | 2,860 | 17 | 7 |

Only after treatment (c)—i.e. in accordance with the invention—was a sufficiently desized, absorbent and satisfactorily dyeable textile obtained, and nevertheless there was no objectionable damage to the fibers.

EXAMPLE 2

Cotton cloth (150 g/m$^2$) sized with starch (13% on the warp) was impregnated in the laboratory with (a) 60 g/l of NaOH
(b) 60 g/l of NaOH
6 g/l of $Na_2S_2O_8$
(c) 60 g/l of NaOH
1.5 g/l of $Na_2S_2O_8$
2 g/l of a copolymer of 95% of acrylic acid and 5% of acrylonitrile (K value 50, measured on a 1% strength solution in $H_2O$).

The wet pick-up was in each case set to 100%. After steaming for 2 minutes at 100° C., the textile was rinsed hot and cold.

| | Results: | |
|---|---|---|
| | Degree of polymerization | Degree of desizing by the Tegewa method |
| Treatment according to (a) | 2,350 | 3 |
| Treatment according to (b) | 1,750 | 8–9 |
| Treatment according to (c) | 2,240 | 7–8 |

The process according to the invention—treatment (c)—exhibits very good protection of the fibers and produces about the same degradation of the starch as is produced by 4 times the amount of persulfate, which also causes severe damage to the fibers.

EXAMPLE 3

A cotton twill (200 g/m$^2$; 11% starch on the warp threads) was impregnated with (a) 50 g/l of NaOH
0.25 g/l of $K_2S_2O_8$
(b) 50 g/l of NaOH
0.25 g/l of $K_2S_2O_8$
0.5 g/l of a copolymer of 65% of acrylic acid and 35% of acrylonitrile (K value 145, measured on a 1% strength solution in $H_2O$).

The wet pick-up was 100%. After two hours' treatment at 100° C. (pad-roll conditions) followed by a hot wash, the following values were obtained:

| | Degree of polymerization | Degree of desizing by the Tegewa method |
|---|---|---|
| Treatment according to (a) | 1,950 | 4–5 |
| Treatment according to (b) | 2,100 | 9 |

For similar amounts of persulfate, the process according to the invention—treatment (b)—produced more effective desizing, coupled with greater protection of the fibers.

We claim:

1. A process for desizing textiles, consisting of or containing cellulose, in the presence of persulfate, wherein the starch-sized textile is impregnated with a desizing liquor having a pH of from 12 to 14, which contains (a) from 0.1 to 3 g/l of peroxydisulfate and (b) from 0.1 to 5 g/l of a water-soluble polymer of acrylic acid which may contain up to 50 mole% of methacrylamide, acrylamide, acrylonitrile, methacrylonitrile, acrylic acid esters, methacrylic acid esters, methacrylic acid or other ethylenically unsaturated monocarboxylic acids or dicarboxylic acids as copolymerized units, their alkali metal salts or ammonium salts, or alkali metal salts or ammonium salts of copolymers of maleic acid and styrene, maleic acid and a vinyl ester or maleic acid and a vinyl ether, and the impregnated textile is then left to dwell for from 1 to 30 minutes at from 20° to 130° C., after which it is rinsed.

2. The process of claim 1 wherein the impregnated textile is left to dwell for from 1 to 30 minutes at from 90° to 105° C. and at a pH of from 12 to 14.

* * * * *